United States Patent [19]

Marchetti

[11] Patent Number: 4,748,794

[45] **Date of Patent: * Jun. 7, 1988**

[54] MACHINE FOR SEALING CARDBOARD BOXES OF CONSTANT HEIGHT

[76] Inventor: Augusto Marchetti, Piazza Sicilia nr. 7, Milano, Italy, 20146

[ * ] Notice: The portion of the term of this patent subsequent to Mar. 3, 2004 has been disclaimed.

[21] Appl. No.: 23,397

[22] Filed: Mar. 9, 1987

Related U.S. Application Data

[62] Division of Ser. No. 807,028, Dec. 9, 1985, Pat. No. 4,653,247.

[30] Foreign Application Priority Data

Dec. 17, 1984 [IT] Italy ..... 24083 A/84

[51] Int. Cl.[4] ..... B65B 59/02

[52] U.S. Cl. ..... 53/137; 53/374; 493/478

[58] Field of Search ..... 53/137, 374; 493/478, 493/479, 477; 156/468, 475, 486

[56] References Cited

U.S. PATENT DOCUMENTS

| | | | |
|---|---|---|---|
| 4,161,138 | 7/1979 | Marchetti | 53/374 X |
| 4,543,150 | 9/1985 | Marchetti | 53/137 X |
| 4,572,760 | 2/1986 | Marchetti | 53/137 X |
| 4,653,247 | 3/1987 | Marchetti | 53/137 |
| 4,658,563 | 4/1987 | Lissoni | 493/478 X |

*Primary Examiner*—James F. Coan

*Attorney, Agent, or Firm*—Cushman, Darby & Cushman

[57] ABSTRACT

An upper taping head is fixed to a vertically movable cross-piece whose ends are engaged in two fixed support and guide columns. To adjust the position of the cross-piece, there is provided at least one threaded rod borne in a rotating manner by one end of the cross-piece and engaged in a nut screw which is fastened to the corresponding fixed column. A control crank may be placed on the top of the threaded rod or shifted toward the center-line of the cross-piece and connected to the cross-piece by a transmission chain borne by the cross-piece. A second threaded rod may be provided for the other end of the movable cross-piece and connected by a transmission chain borne by the cross-piece to the first rod and to a control crank shifted toward the center-line of the column.

4 Claims, 5 Drawing Sheets

MACHINE FOR SEALING CARDBOARD BOXES OF CONSTANT HEIGHT

CROSS-REFERENCE TO RELATED APPLICATION

This application is a division of Ser. No. 807,028 filed on Dec. 9, 1985, now U.S. Pat. No. 4,653,247.

BACKGROUND OF THE INVENTION

1. Field of the Invention

The present invention relates to a machine for sealing cardboard boxes of constant height.

2. Description of the Related Art

Known machines for sealing cardboard boxes comprise in general a bed describing a table for support and advancement of the boxes, devices for pulling the boxes along said supporting table, and at least one taping unit supported in a raised position above said supporting table in such a manner as to engage with the top of the box and apply thereto a sealing adhesive tape during advancement of the boxes along said supporting table.

Said machines are divided in two classes: those for boxes of constant shape (even though it may vary from one series of boxes to the next) and those for boxes of continuously changing shape.

Machines of the first class are distinguished from those of the second class by having operational members, in particular the upper taping head, in a fixed position during a work cycle on a series of boxes but preliminarily adjustable at the beginning of a subsequent cycle to adapt the machine to a possibly different series of a subsequent series of boxes.

To permit the aforesaid fixed adjustable arrangement of the upper taping head, presently known machines have the upper head mounted on a vertically movable cross-piece engaged at the ends with two supporting guide columns fixed to the bed at the two sides of the box support and advancement table. A threaded rod housed in and engaged in a rotating manner with one of the two columns and fitted with a control crank is engaged with a nut screw fixed to the movable cross-piece to raise and lower said cross-piece and hence the taping head to the position required each time for the height of the boxes to be sealed. For large heavy machines a second screw engagement may be provided in the other column, which otherwise acts only as a guide, using a second threaded rod connected operationally to the first by a chain which develops from one column to the other inside a protective hood under the box support table. See U.S. Pat. No. 4,161,138.

Screw adjustment systems of this type are widely used and ensure correct adjustment of the taping head position. In the version described above they have however the drawback of requiring high columns to ensure control and guidance of the movement of the cross-piece to heights such as to allow passage and sealing of very high boxes. As a result the fixed columns must have the maximum height expected for the highest boxes with the consequent high fixed overall dimensions, which are useless for low boxes. The threaded rods must be very long to the detriment of their strength. At the same time in the version with two threaded rods connected by a chain, the presence of the chain prevents moving the columns upward from the bed to allow access for very high boxes.

SUMMARY OF THE INVENTION

In view of the foregoing, the object of the present invention is to achieve a machine for sealing cardboard boxes of constant height which provides a better system of adjustment of the position of the upper taping head.

According to the invention, this object is achieved by a machine which comprises a bed that describes a box support and advancement table, devices for pulling the boxes along said supporting table, and at least one taping unit support in a raised position which is adjustable above said supporting table, said taping unit being fixed to a vertically movable cross-piece engaged at the ends in two support and guide columns secured to the bed at the two sides of said supporting table and being provided with devices for adjusting the height of said cross-piece above said supporting table characterized in that said adjustment devices comprise at least one vertical threaded rod extending in a rotating manner from one end of said cross-piece and engaged with a nut screw operationally constrained by the corresponding fixed column.

In other words, the machine in accordance with the invention provides adjustment of the position of the upper taping head by a threaded rod no longer engaged in a rotating manner with the fixed column and engaged with a nut screw fixed to the movable cross-piece but placed in the opposite condition, i.e. extending in a rotating manner from the movable cross-piece and engaged with a nut screw operationally constrained by the fixed column.

This makes it possible to have the same effective adjustment effect with no need for particularly high columns even for high boxes. The fixed columns may in fact be of limited height because it is the cross-piece fitted with appropriate side guides which rises until it comes out of the space occupied by the fixed columns and up to the desired height. The result is small overall fixed dimensions, which is clearly helpful in installation and employment of the machine in places which may have low overhead clearance and without transportation problems.

For light machines to be used with low boxes it may be preferable, in order to have a simpler structure, to use a single threaded adjustment rod fitted with a control crank mounted on its table. In this case the corresponding fixed column would have to be quite low as a function of the reduced height of the boxes to be sealed.

This arrangement is therefore not suitable for machines designed to seal high boxes and which require higher guide columns. In this case, according to the invention, the threaded adjustment rod is controlled by a crank no longer mounted on the top of said rod but shifted toward the center-line of the movable cross-piece and operationally connected to said threaded rod by a transmission chain housed in said cross-piece. In this manner both the fixed columns may be of appropriate height but in any case low as compared with the conventional art.

For large heavy machines designed for wide and high boxes the machine according to the invention includes two threaded adjustment rods, one located at each end of the movable cross-piece and both controlled by a single control crank shifted toward the center-line of the cross-piece and operationally connected to said threaded rods by a transmission chain housed in said cross-piece.

It is clear that in this case as compared with the corresponding version with two threaded rods according to the known art the further advantage of being able to change at will the height of the fixed columns above the bed without being obstructed by the chain connecting the two threaded rods is obtained. This makes possible adaptation of the fixed columns to particularly high boxes.

BRIEF DESCRIPTION OF THE DRAWINGS

These and other characteristics of the present invention will be made clear by the following detailed description of some of its practical embodiments illustrated as examples in the annexed drawings wherein.

DETAILED DESCRIPTION OF THE PREFERRED EMBODIMENTS

Figure 1:
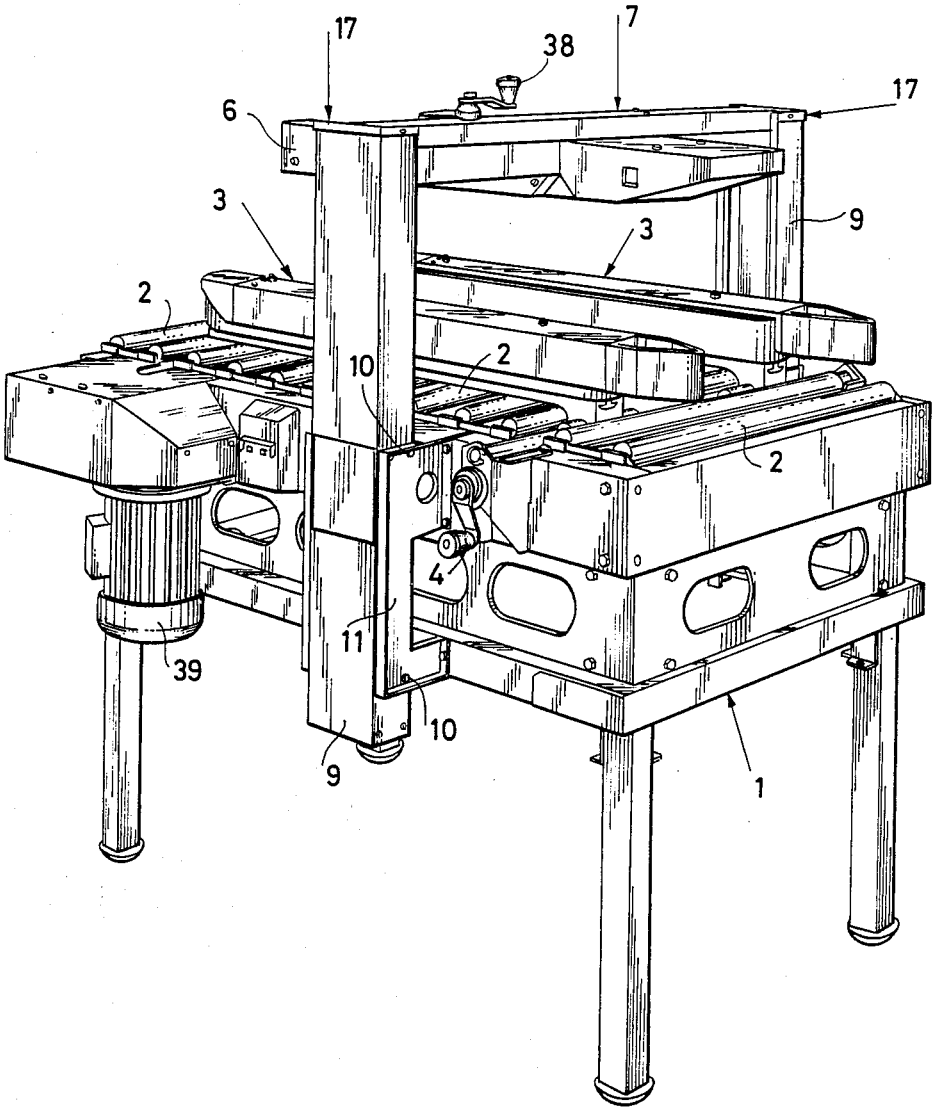
FIG. 1 shows a perspective view of a first embodiment of the machine according to the invention.

Referring to FIGS. 1–6, a machine is illustrated therein for the sealing of cardboard boxes of constant height which comprises basically a bed 1 having idling rollers 2 which form a horizontal support and advancement table for the boxes, a pair of belt pullers 3 arranged along the two sides of said support table at a mutual distance which can be adjusted by operation of a crank 4, an optional lower taping unit (not shown) to be inserted in a recess of the bed 1, and an upper taping unit 5 (shown schematically in FIG. 2) to be fixed to two support arms 6 which are in turn fixed to a cross-piece 7 which is movable vertically with respect to the box support table.

Figure 2:
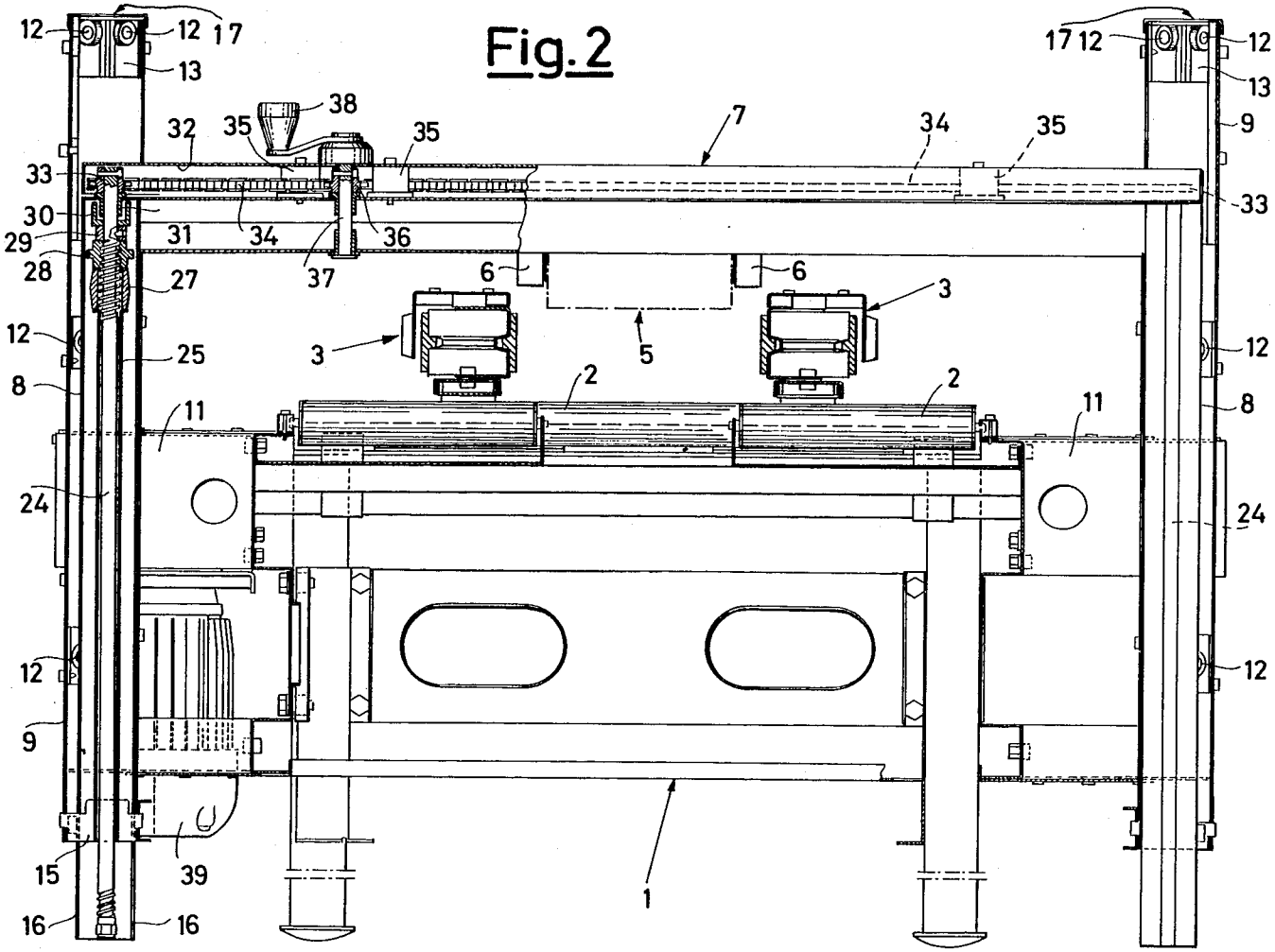
FIG. 2 shows said machine in cross section through the two fixed columns and the movable cross-piece which supports the upper taping head.
Figure 3:
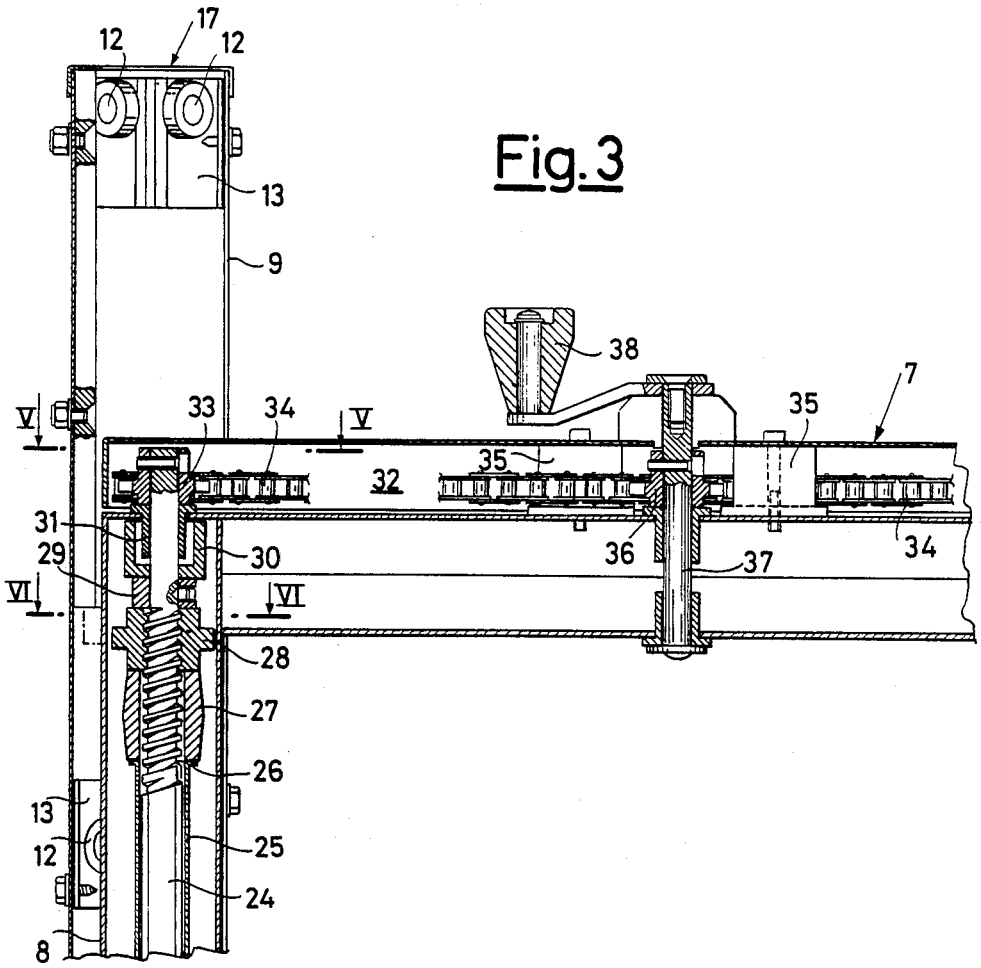
FIG. 3 shows an enlarged part of the system for adjusting the position of the movable cross-piece which is called for in the machine shown in FIGS. 1 and 2.
Figure 5:
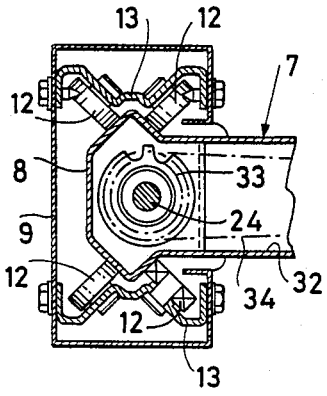
FIG. 5 shows an enlarged part of said adjustment system in a sectional view along a plane of cut V—V of FIG. 3.
Figure 6:
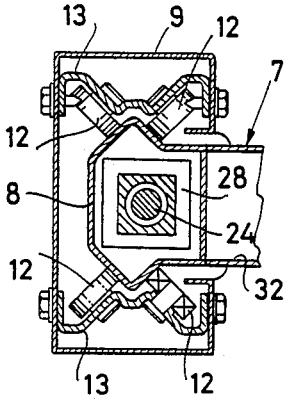
FIG. 6 shows another enlarged part of said adjustment system in a cross-sectional view along a plane of cut VI—VI of FIG. 3.
Figure 7:
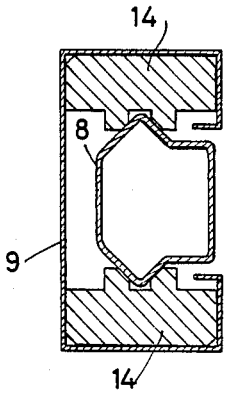
FIG. 7 shows the same part as FIG. 6 in a second embodiment.
Figure 4:
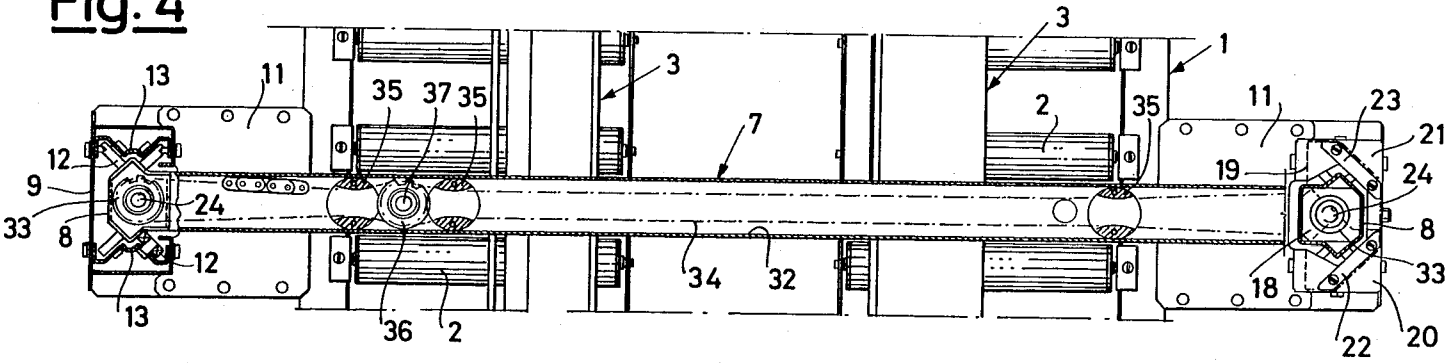
FIG. 4 shows a partially cutaway top view of the detail of said cross-piece and of the adjusting device combined therewith.

As shown in FIGS. 2 and 3, from the end of the cross-piece 7 extend orthogonally downward two box-type arms 8 which are housed in a sliding manner in vertical box-type columns 9 which are secured with screws 10 to support brackets 11 which are fixed in turn to the bed 1. To guide the sliding box-type arms 8 there are provided assemblies of idling rollers 12 borne in a rotating manner by support walls 13 inserted in and fixed to the inside of the columns 9 (FIGS. 4–6). In one embodiment, the rollers 12 and the walls 13 may be replaced by sliding shoes 14 as illustrated in FIG. 7. As illustrated in FIG. 1 the fixed vertical box-type columns 9 are fitted at the bottom with radial cross-pieces 15 and the box-type arms 8 are correspondingly fitted with longitudinal slots 16 at their lower ends to allow them to slide freely to the lowest position as illustrated in FIG. 2. At the table the vertical box-type columns 9 are fitted with covering elements 17 having cloth walls 18 and 19 (indicated with broken lines in FIG. 4) held between the metal walls 20 and 21 and securing strips 22 and 23.

To control vertical movement of the cross-piece 7 and thus adjust the vertical position of the upper taping unit 5 as shown in FIG. 2, there are provided inside the two boxed arms 8 vertical threaded rods 24 housed in a rotating and sliding manner in tubular sheaths 25 fixed at the bottom to columns 9 by radial cross-pieces 15. At the top as shown in FIG. 3, above a terminal fold 26 of the sheath 25, each threaded rod 24 passes freely through a flexible sleeve 27 and then engages in a nut screw 28 formed in such a manner that it can slide axially but cannot turn with respect to its boxed arm 8 (FIG. 6). Immediately above the nut screw 28 on the rod 24 there is fixed a lock ring 29 on which is butted a bell 30 which supports the weight of the cross-piece 7 and surrounds a bush 31 through which the threaded rod 24 ends in a closed box-type recess 32 in the cross-piece 7 (FIG. 3). On the upper end of the threaded rod 24, there is fitted and locked a gear 33 which a transmission chain 34 housed in the box-type recess 32 of the cross-piece 7 and appropriately guided by U-shaped shoes 35 (FIGS. 2–4) connects operationally to the corresponding gear 33 of the other threaded rod 24 and to a drive gear 36 mounted and fixed on a vertical shaft 37 supported in a revolving manner by the cross-piece 7 in a position shifted toward the center-line of the machine (FIG. 1). A control crank 38 is fixed to the mounted shaft 37 above the cross-piece 7.

The adjusting system just described is employed for the initial setting up of the machine, i.e. for adjustment of the vertical position of the taping unit 5 in relation to the height of the boxes to be taped, which is constant for a given series, but sometimes variable from one series to the next. Basically, by rotation of the control crank 38 and with the aid of the transmission chain 34, the two threaded rods 24 are rotated and, being engaged with the nut screws 28, which in turn are held in engagement with the elastic sleeves 27 below by the weight of the components above, rise or fall axially together with the box-type arms 8 and the cross-piece 7 to correspondingly adjust the vertical position of the upper taping unit 5. Said movement is effectively guided by the idling rollers 12 which allow extended and correctly guided movement of the box-type arms 8 even with short columns 9. When the desired position has been reached, working pressure is provided by the weight of the movable assembly, which is cushioned by the elastic sleeves 27. At this point the boxes may be placed one behind the other on the support table formed by the rollers 2 and caused to advance along said table by the belt pullers 3, which are in turn adjusted by the control crank 4 and motorized by a motor 39. Passing under the upper taping unit 5, the boxes receive on their tops predetermined pieces of sealing tape. In a similar manner their bottoms are sealed by the lower taping unit.

The adjusting system described above using two threaded rods 24 and a chain 34 is particularly suitable for a machine designed for boxes which are high and wide and for this reason heavy and large. In this case the two threaded rods 24 ensure the best control and guide conditions for the two ends of the support cross-piece 7 of the upper taping unit 5.

Figure 8:
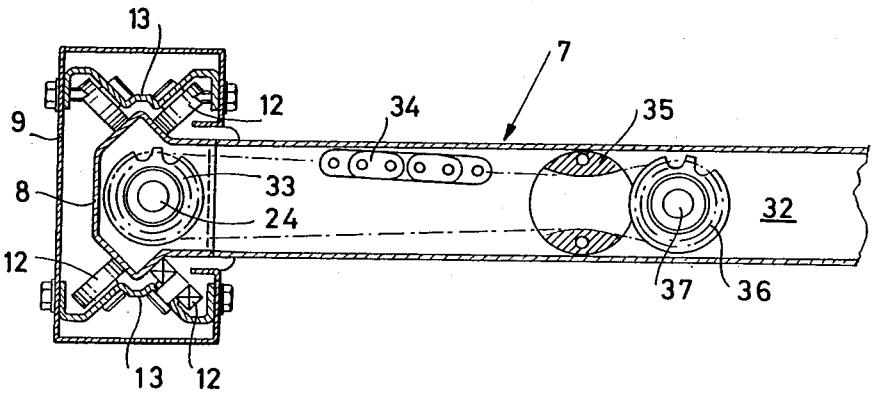
FIG. 8 shows an enlarged top view of a part of another embodiment of the adjustment system illustrated in the preceding figures.

For light-duty machines, however, a single threaded rod may suffice and in this case, as shown in FIG. 8, the chain 34 connects only one gear 33 to the drive gear 36. Where the threaded rod 24 is not provided, there is only guide engagement between the boxed arm 8 and the fixed column 9. The mode of operation is the same.

Figure 9:
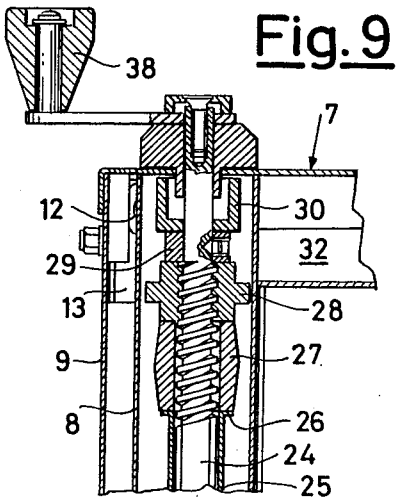
FIG. 9 shows an enlarged vertical cross-sectional view of a part of another embodiment of the adjustment system illustrated in the preceding figures.
Figure 10:
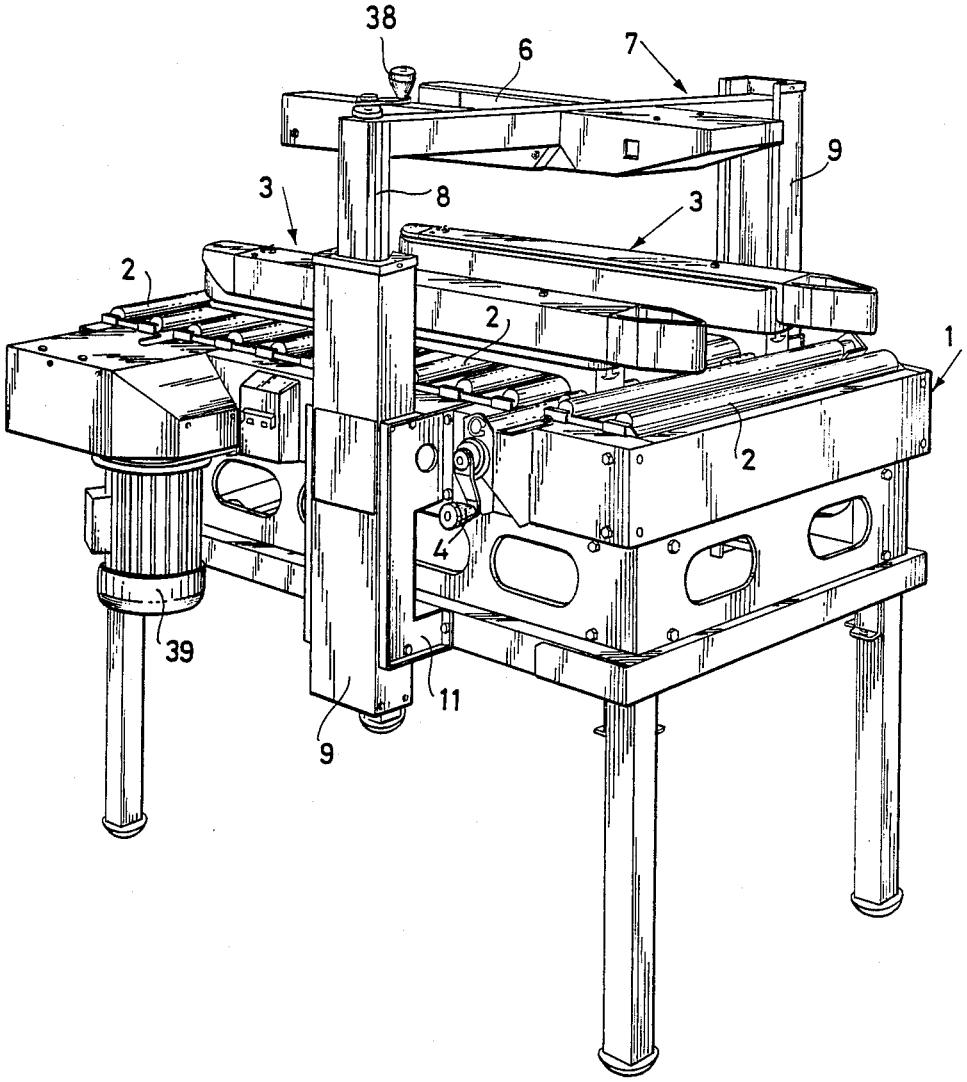
FIG. 10 shows an overall perspective view of the machine according to the embodiment of FIG. 9.

For smaller machines, i.e. those designed to seal boxes of moderate height and width which do not require very high columns, the control crank 38 may be placed directly on the top of the single threaded rod 24 (FIG. 9), thus doing away with the chain 34 and the gears 33 and 36. In compensation the height of one of the fixed columns 9 must be reduced so as to not create an obstacle for the control crank 38 when the cross-piece 7 is in its lowest position. The machine in accordance with this embodiment is illustrated as a whole in FIG. 10. The mode of operation is the same.

I claim:

1. A machine for sealing cardboard boxes, comprising:

a support bed and advancing table for the boxes;

support and guide columns fixed to the support bed at opposite sides of the table;

cross-piece vertically movable and engageable at opposite ends to the support and guide columns;

at least one taping unit being fixed to the cross-piece and supported in an adjustably raised position above the table;

a nut screw operatively connected in each of the support and guide columns;

at least one vertically oriented and threaded rod borne in a rotating manner by one end of the cross-piece, said threaded rod having a top end and being engaged in the nut screw; and crank means, fixed to the top end of the threaded rod, for controlling and adjusting the height of the cross-piece above the table.

2. The machine according to claim 1, further comprising:

a tubular sheath means, fixed to the support and guide columns, for housing the threaded rod in a sliding manner.

3. The machine according to claim 2, further comprising:

a flexible sleeve cushioned between the nut screw and the tubular sheath.

4. The machine according to claim 1, further comprising:

integrally boxed arms housed and guided in a sliding manner in the support and guide columns, said arms extending downwardly from ends of the cross-piece.

* * * * *